US007930797B2

(12) United States Patent
Yoo

(10) Patent No.: US 7,930,797 B2
(45) Date of Patent: Apr. 26, 2011

(54) SUCTION BRUSH ASSEMBLY CAPABLE OF AUTOMATIC HEIGHT ADJUSTMENT

(75) Inventor: Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 953 days.

(21) Appl. No.: 11/818,717

(22) Filed: Jun. 15, 2007

(65) Prior Publication Data

US 2008/0172820 A1 Jul. 24, 2008

Related U.S. Application Data

(60) Provisional application No. 60/897,148, filed on Jan. 24, 2007.

(30) Foreign Application Priority Data

Mar. 12, 2007 (KR) ..... 10-2007-0023957

(51) Int. Cl.
*A47L 9/28* (2006.01)

(52) U.S. Cl. ..... 15/319; 15/355; 15/368

(58) Field of Classification Search ..... 15/319, 15/355, 368; *A47L 9/28*
See application file for complete search history.

(56) References Cited

U.S. PATENT DOCUMENTS 3,849,823 A * 11/1974 Adamson et al. ..... 15/50.1
4,706,327 A * 11/1987 Getz et al. ..... 15/319
6,123,779 A * 9/2000 Conrad et al. ..... 134/21
6,883,204 B2 * 4/2005 Salice ..... 16/245
7,237,298 B2 * 7/2007 Reindle et al. ..... 15/319
7,316,051 B2 * 1/2008 Budd ..... 15/361
7,578,020 B2 * 8/2009 Jaworski et al. ..... 15/50.3

FOREIGN PATENT DOCUMENTS

| | | | |
|---|---|---|---|
| JP | 05-220075 | | 8/1993 |
| JP | 06254012 | * | 9/1994 |
| JP | 08-000519 | | 1/1996 |
| KR | 100232102 | | 9/1999 |
| KR | 10200500636949 | | 6/2005 |

OTHER PUBLICATIONS

Office Action dated Dec. 13, 2007 corresponding to Korean Patent Application No. 10-2007-0023957.

* cited by examiner

*Primary Examiner* — David A Redding
(74) *Attorney, Agent, or Firm* — Ohlandt, Greegley, Ruggiero & Perle, LLP

(57) ABSTRACT

A suction brush assembly for a vacuum cleaner capable of automatic height adjustment according to the present disclosure includes a suction brush body connected to a cleaner body at a rear side thereof and provided with a rotation brush for striking a surface to be cleaned to separate dirt from the surface to be cleaned at a bottom surface thereof; and an up/down adjusting unit for monitoring continuously a state of the surface to be cleaned and adjusting a height of the rotation brush body to vary a distance between the surface to be cleaned and the rotation brush according to the state of the surface to be cleaned so as to prevent the surface to be cleaned from being damaged by the rotating rotation brush.

10 Claims, 3 Drawing Sheets

SUCTION BRUSH ASSEMBLY CAPABLE OF AUTOMATIC HEIGHT ADJUSTMENT

CROSS-REFERENCE TO RELATED APPLICATIONS

This application claims the benefit of Korean Patent Application No. 10-2007-23957, filed Mar. 12, 2007, with the Korean Intellectual Property Office, and U.S. provisional Application No. 60/897,148, filed Jan. 24, 2007, with the US PTO, the entire disclosure of both of which are hereby incorporated by reference.

BACKGROUND OF THE INVENTION

1. Field of the Invention

The present disclosure relates to a vacuum cleaner, and more particularly, to a suction brush assembly of a vacuum cleaner for drawing-in dirt from a surface to be cleaned.

2. Description of the Related Art

A suction brush assembly which is built in a vacuum cleaner is an apparatus for drawing-in, in a case that a bottom surface thereof is in contact with a surface to be cleaned, dust or dirt which exists on the surface to be cleaned by a suction force generated by a suction motor disposed in an inside of a cleaner body.

However, a suction brush, particularly adapted to an upright type vacuum cleaner of these conventional suction brushes, is provided with a suction brush body which is hinged at a lower end of a cleaner body and a driving motor and a rotation brush which are disposed inside of the brush body, the rotation brush rotates by receiving a rotation force from the driving motor through a belt.

The rotation brush is rotatably supported at both ends by a front case that is coupled to a front of the suction brush body. The rotation brush can remove dirt efficiently from a surface to be cleaned by applying impact energy to the dirt stuck to the surface to be cleaned and thus promoting the dirt to be separated from the surface to be cleaned.

In the conventional suction brush assembly, however, a friction resistance generated in the rotation brush is very small in a case of cleaning a conventional flat floor while there is a problem, in a case of cleaning a carpet, that the motor is subjected to a load as the rotating rotation brush is rubbed against pile of the carpet to generate a friction resistance and the friction resistance is transferred to a driving shaft of the driving motor through the belt.

A suction brush moving up/down apparatus has therefore been developed in order to reduce a friction resistance between the rotation brush and the pile of the carpet by moving the rotation brush up when cleaning the carpet and down when cleaning the conventional flat floor. In the suction brush moving up/down apparatus, an adjusting part having a generally lever shape or rotation knob shape projects to an outside of the suction brush body and a user operates the adjusting part directly by his or her hand or foot during cleaning according to the kind of the surface to be cleaned, i.e. whether the surface is a flat floor or a carpet to adjust the height of the suction brush.

However, in the case of using a cleaner without adjusting the height of the suction brush according to a state of the surface to be cleaned as lack of an appreciation to an operation of a cleaner, there are problems that if the surface to be cleaned is a carpet, the carpet is damaged by the rotation brush and the driving motor is subjected to a load by the above described friction resistance.

In addition, it is very troublesome to operate the adjusting part in the case that the user can not easily operate the cleaner by his or her physical handicap even though the user appreciates sufficiently the operation of a cleaner.

SUMMARY OF THE INVENTION

The present disclosure has been developed in order to overcome the above drawbacks and other problems associated with the conventional arrangement. An aspect of the present disclosure is to provide a suction brush capable of adjusting automatically a height of suction brush according to kind or status of a surface to be cleaned.

The above aspect and/or other feature of the present disclosure can substantially be achieved by providing a suction brush assembly, which comprises a suction brush body connected to a cleaner body at a rear side thereof and provided with a rotation brush for striking a surface to be cleaned to separate dirt from the surface to be cleaned at a bottom surface thereof; and an up/down adjusting unit for monitoring continuously a state of the surface to be cleaned and adjusting a height of the rotation brush body to vary a distance between the surface to be cleaned and the rotation brush according to the state of the surface to be cleaned so as to prevent the surface to be cleaned from being damaged by the rotating rotation brush.

In this case, the up/down adjusting unit may comprise a current detecting sensor for detecting a variation in current generated in a first motor for driving the rotation brush by a friction resistance generated between the rotation brush and the surface to be cleaned; an up/down driving part for moving up/down a front side of the suction brush so as to maintain a contacting distance between the rotation brush and the surface to be cleaned; and a control part for comparing a current variation signal detected by the current detecting sensor with a preset current range and driving the up/down driving part according to the compared value.

In addition, the above aspect and/or other feature of the present disclosure can also be achieved by providing a suction brush assembly, which comprises a suction brush body for drawing-in dirt on a surface to be cleaned to introduce the drawn-in dirt to a cleaner body; a rotation brush disposed at a front of the suction brush body and driven to rotate by a first motor so as to promote a separation of the dirt from the surface to be cleaned; a pair of main wheels rotatably coupled to both sides of the rear side of the suction brush body respectively; a current detecting sensor for detecting a variation in current generated in the first motor by a friction resistance generated between the rotation brush and the surface to be cleaned; an up/down driving part disposed in an inside of the suction brush body, for moving up/down a front side of the suction brush so as to maintain a contacting distance between the rotation brush and the surface to be cleaned; and a control part for comparing a current variation signal detected by the current detecting sensor with a preset current range and driving the up/down driving part according to the compared value.

In this case, the up/down driving part may comprise a second motor for rotating in forward or reverse according to a driving signal transmitted from the control part; a wheel shaft having an end hinged to the suction brush body and the other end to which at least an auxiliary wheel is mounted; and a power transmitting part disposed between the second motor and the wheel shaft, for transmitting a rotation force of the second motor to the wheel shaft, wherein the wheel shaft receiving the rotation force from the second motor through the power transmitting part turns on the other end thereof and thus the suction brush body is moved up or down on the pair of the main wheel as it turns on the other end thereof, thereby capable of preventing a carpet from being damaged by the moving up of the rotation brush in a case that the surface to be cleaned varies from a floor to the carpet.

The power transmitting part may comprise a pinion coupled to an outer periphery of a driving shaft of the second motor; and a rack coupled to a portion of the wheel shaft in a state of rounded upward. In addition, the second motor is a servo motor or a step motor and a height of the suction brush assembly can be accurately controlled as the driving shaft of the second motor is accurately turned by a preset rotation angle.

Other objects, advantages and salient features of the present disclosure will become apparent from the following detailed description, which, taken in conjunction with the annexed drawings, discloses exemplary embodiments of the present disclosure.

BRIEF DESCRIPTION OF THE DRAWINGS

Above and other aspects of the present disclosure will become apparent and more readily appreciated from the following description of the exemplary embodiments, taken in conjunction with the accompany drawings of which.

Throughout the drawings, like reference numerals will be understood to refer to like parts, components and structures.

DETAILED DESCRIPTION OF THE EXEMPLARY EMBODIMENTS

Certain exemplary embodiments of the present disclosure will be described in greater detail with reference to the accompanying drawings.

The matters defined in the description, such as a detailed construction and elements thereof, are provided to assist in a comprehensive understanding of the present disclosure. Thus, it is apparent that the present disclosure may be carried out without those defined matters. Also, well-known functions or constructions are omitted to provide a clear and concise description of exemplary embodiments of the present disclosure.

Figure 1:
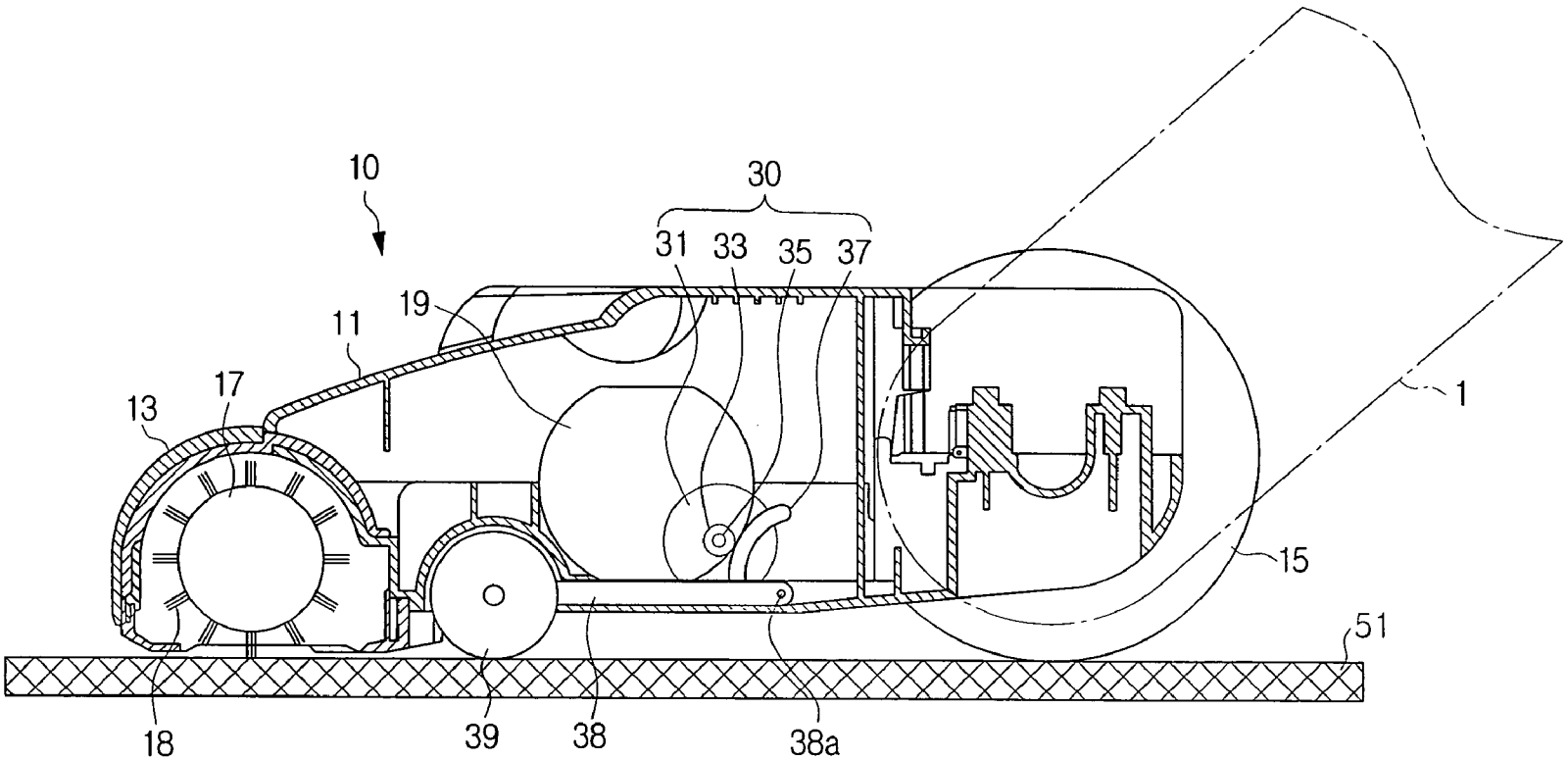
FIG. 1 is a cross-sectional view schematically illustrating a suction brush assembly according to an exemplary embodiment of the present disclosure in a state of being placed on a standard flat floor.
Figure 2:
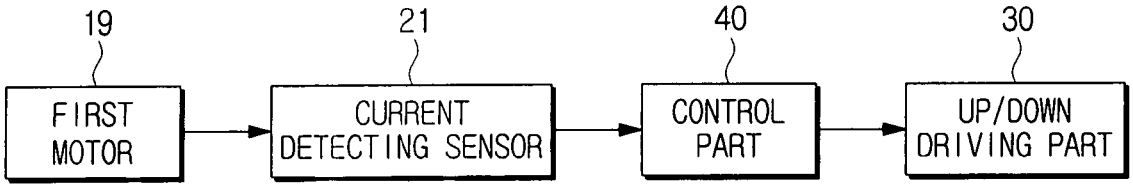
FIG. 2 is a block diagram illustrating a mechanism for controlling an up/down driving of the suction brush assembly of FIG. 1.

Referring to FIGS. 1 and 2, a suction brush assembly 10 comprises a suction brush body 11, a front case 13, a main wheel 15, a rotation brush 17, a first motor 19, a current detecting sensor 21, an up/down driving part 30, and a control part 40.

A rear portion of the suction brush body 11 is hinged at a lower end of a cleaner body 1 and main wheels 15 are rotatably disposed at both sides of a rear portion of the body 11.

The front case 13 is disposed at a front of the suction brush body 11. Inside the front case 13 are rotatably coupled both ends of the rotation brush 17 for striking or scraping dirt stuck to a surface 51 to be cleaned.

The rotation brush 17 has a drum shape and on an outer periphery thereof is implanted a plurality of bristles 18; in this case, the rotation brush 17 receives a rotation force from the first motor 19, which is disposed in an inside of the suction brush body 11 through a driving belt (not illustrated).

The current detecting sensor 21 is disposed in an inside of the suction brush body 11, electrically connected to the first motor 19, illustrated in FIG. 2, for detecting a variation in current of the first motor 19 and electrically connected to the control part 40 for transmitting a current variation signal according to the variation in current detected from the first motor 19 to the control part 40.

The up/down driving part 30 comprises a second motor 31, power transmitting parts 35 and 37, a wheel shaft 38, and a plurality of auxiliary wheels 39. A servo motor or a step motor may be used as the second motor 31 and a driving shaft 33 of the second motor 31 is arranged so as to be generally perpendicular to the wheel shaft 38. The power transmitting parts include a pinion 35 and a rack 37, which are arranged between the second motor 31 and the wheel shaft 39 to transmit a rotation force of the second motor 31 to the wheel shaft 38. The pinion 35 is a spur gear and is coupled to an outer periphery of the driving shaft 33 of the second motor 31. The rack 37 is coupled to a side of the wheel shaft 38 in an upward direction and has an upper portion rounded in a predetermined curvature so as to face to a rear side of the suction brush assembly 10. The rack 37 is geared into the pinion 35 and, in this case, the curvature of the rack 37 may be set in consideration of a matter relative to a pivot angle of the auxiliary wheel 39 such as a length of the wheel shaft 38, a number of teeth of the pinion 35 and so on. The wheel shaft 38 has an end that is coupled to a hinge shaft **38*a* fixed to the suction brush body 11 and the other end to which the plurality of the auxiliary wheels 39 is rotatably coupled in a predetermined space. The plurality of the plurality of the auxiliary wheels 39 is positioned at a lower side of the suction brush body 11 so that the suction brush assembly 10** can be easily moved on a surface to be cleaned.

The control part 40 receives the current variation signal which is continuously inputted from the current detecting sensor 21, compares a rotation direction and revolutions-per-minute (RPM) of a positive or reverse rotation of the second motor 31 according to predetermined range of current which is preset, and then transmits a driving signal based on the compared value to the second motor 31 thereby driving the second motor 31.

Hereinafter, an operation of the suction brush assembly 10 according to an exemplary embodiment of the present disclosure will be described. In this exemplary embodiment will described exemplary a case that a state of a surface to be cleaned varies, that is, a case that the suction brush assembly 10 moves from a floor to a carpet.

Referring to FIG. 1, the suction brush assembly 10 moves smoothly on a surface to be cleaned through the main wheel 15 and the auxiliary wheel 3 in a case that the surface to be cleaned is a flat floor 51. In this case, if driving the first motor 19 to rotate the rotation brush 17, the bristles 18 strike or scrape the smooth floor 51 to separate dirt stuck to the surface to be cleaned illustrated in FIG. 1. In this case, the bristles 18 are rubbed against to the floor 51 by rotation of the rotation brush 17 and, at this time, it may be that an initial height of the rotation brush 17 is set such that a friction resistance generated in the bristles 18 does not give a load.

Figure 3:
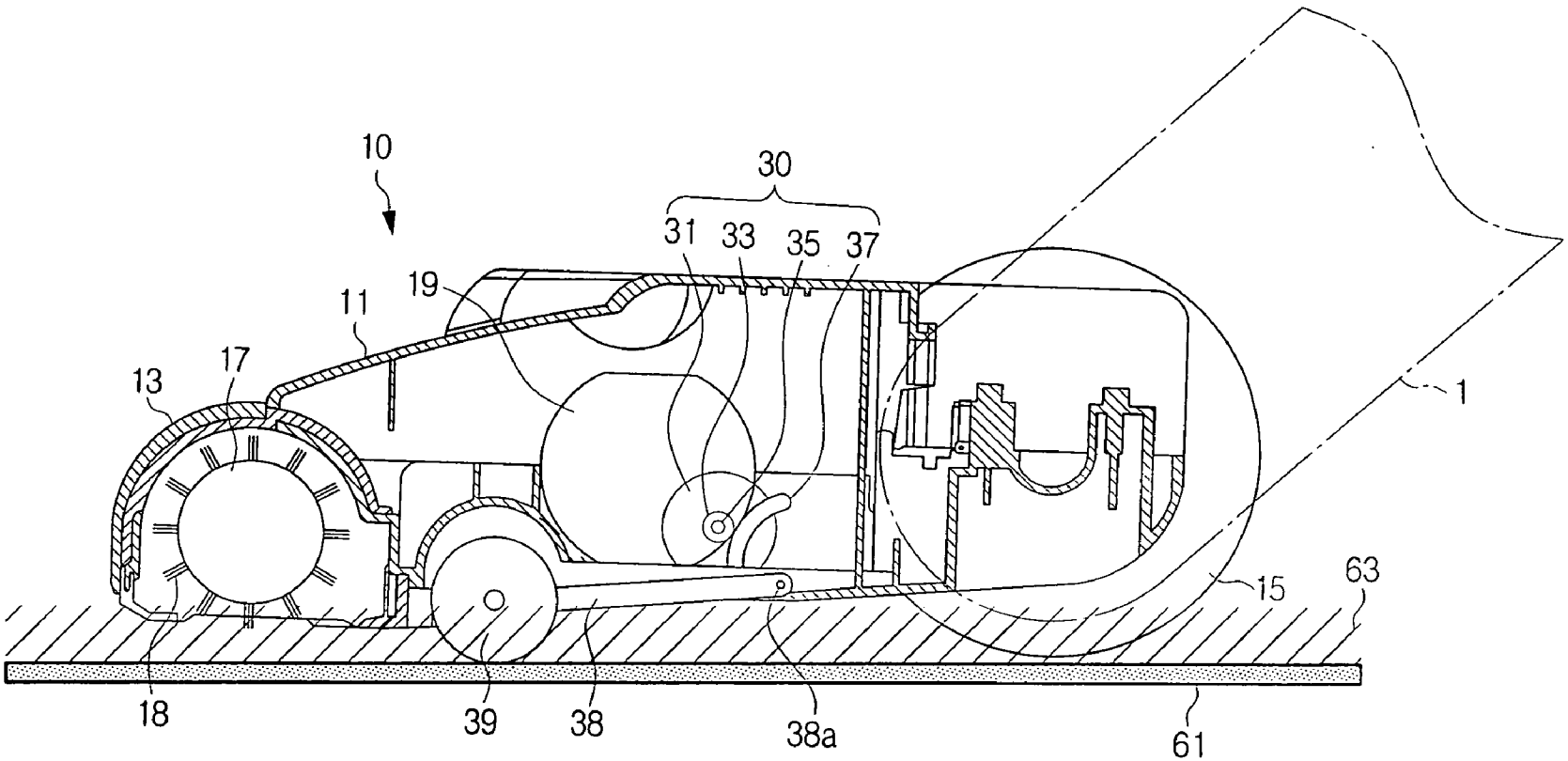
FIG. 3 is a cross-sectional view schematically illustrating the suction brush assembly of FIG. 1 in a state of being placed on a carpet.

Meanwhile, in a case that a kind of the surface to be cleaned is varied from the floor 51 to a carpet 61 illustrated in FIG. 3 during cleaning, the rotation brush 17 which is rotating comes to contact with the plurality of the piles 63 which project upward from a bottom of the carpet 61 and thus a friction resistance is generated which is significantly larger than the friction resistance on the floor 51. In this case, the friction resistance generated on the carpet 61 may vary as a height of pile 63 of the carpet. As such, the friction resistance generated between the rotation brush 17 and the carpet 61 decreases a rotation speed of the rotation brush 17 and at the same time gives a load to the first motor 19.

Accordingly, a variation in current is generated in the first motor 19 by the generated load and the current detecting sensor 21 (see FIG. 2) detects the varied current and transmits a current detection signal to the control part 40.

The control part 40 compares the received current detection signal with a preset current range to determine a rotation direction and RPM of a positive or reverse rotation of the servo motor and rotates the second motor 31 in the determined rotation direction and RPM. Accordingly, the pinion 35 coupled to the driving shaft 33 of the second motor 31 rotates in a same direction as the rotation direction of the driving shaft 33 and thus the rack 37, which is interlocked with the pinion 35, turns the other end of the wheel shaft 38 downward on the hinge shaft 38*a*. In this case, the auxiliary wheel 39 is turned downward in a state of pressing the carpet 61 by the wheel shaft 38 and thus a front side of the suction brush body 11 is turned upward by a predetermined angle on a rotation center of the main wheel 15. In this case, the rotation brush 17 is elevated to go away from the carpet 61 and thus inter-contact area between the bristles 18 and the piles 63 of the carpet 61 is reduced and a friction resistance generated between the rotation brush 17 and the carpet 61 is gradually reduced.

As such, the load applied to the first motor 19 is also reduced with reduction of the friction resistance and current detected by the current detecting sensor 21 is also varied. The control part 40 receives continuously the current detection signal of the first motor 19 from the current detecting sensor 21 and controls the second motor 31 to stop its driving if the current is reduced to a preset current range.

In this case, the current range which is preset in the control part 40 for stop driving of the second motor 31 is limited to such that a some friction resistance exists between the rotation brush 17 and the carpet 61. This is because if cleaning the carpet 61 is finished and cleaning a floor 51 is continuously performed illustrated in FIG. 1, the friction resistance existing between the rotation brush 17 and the carpet 61 is disappeared and thus the current of the first motor 19 detected by the current detecting sensor 21 is minimized. In this case, the control part 40 judges that the front side of the suction brush assembly 10 goes out of the carpet 61 and controls the second motor 31 so that the second motor rotates by a predetermined RPM in a direction opposite to the rotation direction in the case that the surface to be cleaned varies from the floor 51 to the carpet 61.

Accordingly, a distance between the plurality of the auxiliary wheels 39 and the bottom surface of the suction brush body 11 is gradually closer as the rack 37 geared into the pinion 35 is operated with a rotation of the pinion 35 and the other end of the wheel shaft 38 is turned upward on the hinge shaft 38*a*. Consequently, the front side of the suction brush body 11 which has been elevated is turned downward on the rotation center of the main wheel 15 and the bristles 18 of the rotation brush 17 comes to contact again with the floor 51 to perform cleaning.

With the suction brush assembly according to the present disclosure, it is possible to prevent a damage of a surface to be cleaned due to a misusage, for example a damage of a carpet occurred due to a rotation brush, which is generated when manually operating a height of a suction brush since a distance between the rotation brush and a surface to be cleaned is controlled automatically as a state or kind of the surface to be cleaned.

In addition, it is possible to maximize a cleaning efficiency as the rotation brush rotates smoothly in response to a state or kind of a surface to be cleaned.

Although a few exemplary embodiments of the present disclosure have been shown and described, it will be appreciated by those skilled in the art that changes may be made in these exemplary embodiments without departing from the principles and spirit of the disclosure, the scope of which is defined in the appended claims and their equivalents.

What is claimed is:

1. A suction brush assembly, comprising:

a suction brush body connected to a cleaner body at a rear side thereof and provided with a rotation brush for striking a surface to be cleaned to separate dirt from the surface to be cleaned at a bottom surface thereof; and an up/down adjusting unit for monitoring continuously a state of the surface to be cleaned and adjusting a height of the rotation brush body to vary a distance between the surface to be cleaned and the rotation brush according to the state of the surface to be cleaned so as to prevent the surface to be cleaned from being damaged by the rotating rotation brush, wherein the up/down adjusting unit comprises:

a current detecting sensor for detecting a variation in current generated in a first motor for driving the rotation brush by a friction resistance generated between the rotation brush and the surface to be cleaned;

an up/down driving part for moving up/down a front side of the suction brush so as to maintain a contacting distance between the rotation brush and the surface to be cleaned; and a control part for comparing a current variation signal detected by the current detecting sensor with a preset current range and driving the up/down driving part according to the compared value.

2. A suction brush assembly, comprising:

a suction brush body for drawing-in dirt on a surface to be cleaned to introduce the drawn-in dirt to a cleaner body;

a rotation brush disposed at a front of the suction brush body and driven to rotate by a first motor so as to promote a separation of the dirt from the surface to be cleaned;

a pair of main wheels rotatably coupled to both sides of the rear side of the suction brush body respectively;

a current detecting sensor for detecting a variation in current generated in the first motor by a friction resistance generated between the rotation brush and the surface to be cleaned;

an up/down driving part disposed in an inside of the suction brush body, for moving up/down a front side of the suction brush so as to maintain a contacting distance between the rotation brush and the surface to be cleaned; and a control part for comparing a current variation signal detected by the current detecting sensor with a preset current range and driving the up/down driving part according to the compared value.

3. The suction brush assembly of claim 2, wherein the up/down driving part comprises:

a second motor for rotating in forward or reverse according to a driving signal transmitted from the control part;

a wheel shaft having an end hinged to the suction brush body and the other end to which at least an auxiliary wheel is mounted; and a power transmitting part disposed between the second motor and the wheel shaft, for transmitting a rotation force of the second motor to the wheel shaft, wherein the wheel shaft receiving the rotation force from the second motor through the power transmitting part turns on the other end thereof and thus the suction brush body is moved up or down on the pair of the main wheel as it turns on the other end thereof.

4. The suction brush assembly of claim 3, wherein the power transmitting part comprises:

a pinion coupled to an outer periphery of a driving shaft of the second motor; and a rack coupled to a portion of the wheel shaft in a state of rounded upward.

5. The suction brush assembly of claim 3, wherein the second motor is a servo motor or a step motor.

6. A suction brush assembly, comprising:

a brush;

a first motor operatively connected to the brush so that the motor rotates the brush;

a current sensor electrically connected to the first motor, the current sensor detecting a current variation signal from the first motor;

a control part electrically connected to the current sensor so that the control part receives the current variation signal from the current sensor; and a second motor electrically connected to the control part, the second motor being configured to raise or lower the brush with respect to a surface being cleaned based at least in part on the current variation signal.

7. The suction brush assembly of claim 6, wherein the control part continuously receives the current variation signal from the current detecting sensor.

8. The suction brush assembly of claim 6, wherein the control part compares the current variation signal to a selected range of current, and transmits a driving signal based on the compared value to the second motor thereby driving the second motor.

9. The suction brush assembly of claim 6, wherein the second motor is a servo motor.

10. The suction brush assembly of claim 6, wherein the second motor is a step motor.

* * * * *